US006474253B1

(12) United States Patent
Molz

(10) Patent No.: US 6,474,253 B1
(45) Date of Patent: Nov. 5, 2002

(54) TENDER TOWING SYSTEM FOR MOTOR YACHTS

(76) Inventor: Herbert F. Molz, 1556 Cypress Dr., No.14, Jupiter, FL (US) 33469

( * ) Notice: Subject to any disclaimer, the term of this patent is extended or adjusted under 35 U.S.C. 154(b) by 0 days.

(21) Appl. No.: 10/003,023

(22) Filed: Oct. 25, 2001

(51) Int. Cl.[7] ..... B63B 21/04
(52) U.S. Cl. ..... 114/251; 114/253
(58) Field of Search ..... 114/251, 253, 114/242, 247, 248, 249

(56) References Cited

U.S. PATENT DOCUMENTS 3,469,552 A * 9/1969 Patrick ..... 114/246
5,609,120 A * 3/1997 Eronen ..... 114/253
5,746,149 A 5/1998 Molz
5,791,280 A * 8/1998 Egan et al. ..... 114/242
5,927,226 A * 7/1999 Patterson ..... 114/249
6,178,914 B1 * 1/2001 Axelsson ..... 114/242
6,182,592 B1 2/2001 Molz

* cited by examiner

*Primary Examiner*—Jesus D. Sotelo
(74) *Attorney, Agent, or Firm*—McHale & Slavin

(57) ABSTRACT

A tender towing system for motor yachts employing a retractable tow line coupled to a rotatable spool. The rotatable spool is controlled by an operator of the motor yacht by a centralized hydraulic or electrical system. A harness is placed between the tow line and the towed tender to absorb excess shocks. A skeg is located on the transom of the tender to provide proper tracking of the tenders that do not have integrated rudders. A docking port is positioned on the transom area of the motor yacht which in combination with the line retrieval system is used to secure the tender to the transom area of the motor yacht thereby allowing close quarter operation such as that required in marinas and the like docking situations.

4 Claims, 4 Drawing Sheets

TENDER TOWING SYSTEM FOR MOTOR YACHTS

FIELD OF THE INVENTION

This invention is related to the field of boating and in particular to a method and device for towing vessels behind motor yachts.

BACKGROUND OF THE INVENTION

The towing of a tender behind a pleasure boat is commonly performed by having the towed vessel attached to the towing vessel by use of a towing line. For instance, tugboats pull unpowered barges by use of a cable with sufficient distance between the vessels so that the length of the cable operates to cushion against irregular towing conditions. For instance, a cable may be a quarter of a mile long so that the water provides a natural shock absorber for the cable. Pleasure vessels also have a tendency to pull unpowered vessels, or tenders, but cannot afford to have such a distance between the vessels.

A motor yacht cannot accommodate a long line due to the inherent dangers of having such a large distance between the first vessel and the second vessel. For this reason a motor yacht typically tows a tender by use of a nylon line due to the shock absorbing purposes of the line thereby allowing a shorter length of towing line. A problem that occurs in such a situation is that the towing of a vessel places a enormous tension on the towing line. Even a small fishing boat having a length of fifteen feet can place over a thousand pounds of pressure of the towing line is certain sea conditions. To accommodate such a situation, the towing vessel may employ different size lines or multiple lines in order to adjust for the types of seas. Further, placement of the towed water craft at a particular point behind the towing vessel becomes a critical aspect.

The most efficient location for towed vessel may be directly behind the second rise of water caused by the wake of the towing vessel. In this manner the towed vessel is maintained with constant tow line pressure and with minimum experimentation a crew member will know approximately how much line must be laid out in order for the tender to be in a proper position. However, the proper position can change based upon loading of the tender (fuel), sea conditions, and speed of the towing vessel. Thus, a crew member on a hundred-foot Hatteras may position a thirty foot fishing boat approximately four hundred feet behind the motor yacht when the motor yacht is operated at fifteen knots and seas are less than three feet. Should the motor yacht be brought up to eighteen knots the positioning of the tender may no longer be appropriate but it is humanly impossible for a crew member to untie the vessel for purposes of extending the line without endangering life and limb. Further, should the motor yacht reduce speed, the towing line length must be reduced but it is again an impossibility in light of the pressure placed upon the tender while underway. All these situations are further complicated in change of sea conditions. Thus, a vessel crossing the Gulf Stream in an eastern direction will have a different pressure gradient on the tender towing line as does a vessel crossing the Gulf Stream in a westerly direction. In addition, using the Gulf Stream as an example, it is well known that the conditions in the Gulf Stream are remarkably different than the conditions close to the U.S. shore line or Bahamian shores.

All of these variables require tow line changing to accommodate distance between the towing vessel and the tender based upon speed, wind, current, and wave heights. Further, when a vessel that is towing a tender enters a port or travels along a water way where placement of the tender at a large distance behind the towing vessel is not possible, the vessels must be stopped and the tender pulled to an appropriate position before proceeding. Obviously this places a motor vessel in a dangerous predicament should the motor vessel be entering an ocean inlet where any types of seas are present. Should sea conditions change during an excursion, the motor vessel may have adjusted the length of the tender to one sea condition and be ill prepared for a changing sea condition. Further, large motor yachts typically have stabilizers that require the vessel to be moving in order to provide the motor yacht with safe passage. Stopping of a motor yacht in seas obviates the ability for the stabilizer to operate making the motor yacht subject to the sea conditions.

Thus, what is lacking in the art is a method of towing a tender that addresses the need to properly place the towed vessels at the optimal position thereby eliminating the safety hazard of having a crew member perform adjustments, and further provide a docking mechanism for towing of a tender in close positions for towing along a water way, intercostal, or entering of harbors for positive control of the tender becomes an absolute necessity.

SUMMARY OF THE INVENTION

An objective of the invention as to disclose a tender towing system for motor yachts that allows the operator of the motor yacht to single handedly position a towed tender on-the-fly to accommodate boat speed and sea conditions.

Still another objective of the instant invention is to disclose a cradle that allows a towed tender to be retracted into a position that allows for close quarter maneuvering of the motor yacht by temporarily attaching the towed tender to the transom of the motor yacht.

Yet still another objective of the instant invention is to disclose a winch system that is lightweight and powerful enough to retract a tender while the vessels are making way.

Still another objective is to disclose the use of a tender towing skeg that is securable to the transom of the towed tender and deployed for use in preventing skidding of the towed vessel.

Still another objective of the instant invention is to disclose the use of a skeg having opposed fins that operate as rudders to allow the tender to be pulled in a straight line with minimal skidding.

Still, another objective of the instant invention is to disclose the use of a harness having a rubber shock cord encompassed by a nylon cord so as to provide a predetermined expansion of the harness inhibiting premature wear and catastrophic failure.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE DRAWINGS

FIG. 1 sets forth a pictorial of a motor yacht pulling a tender with a length of the line there between;

DETAILED DESCRIPTION OF THE PREFERRED EMBODIMENT

Figure 1:
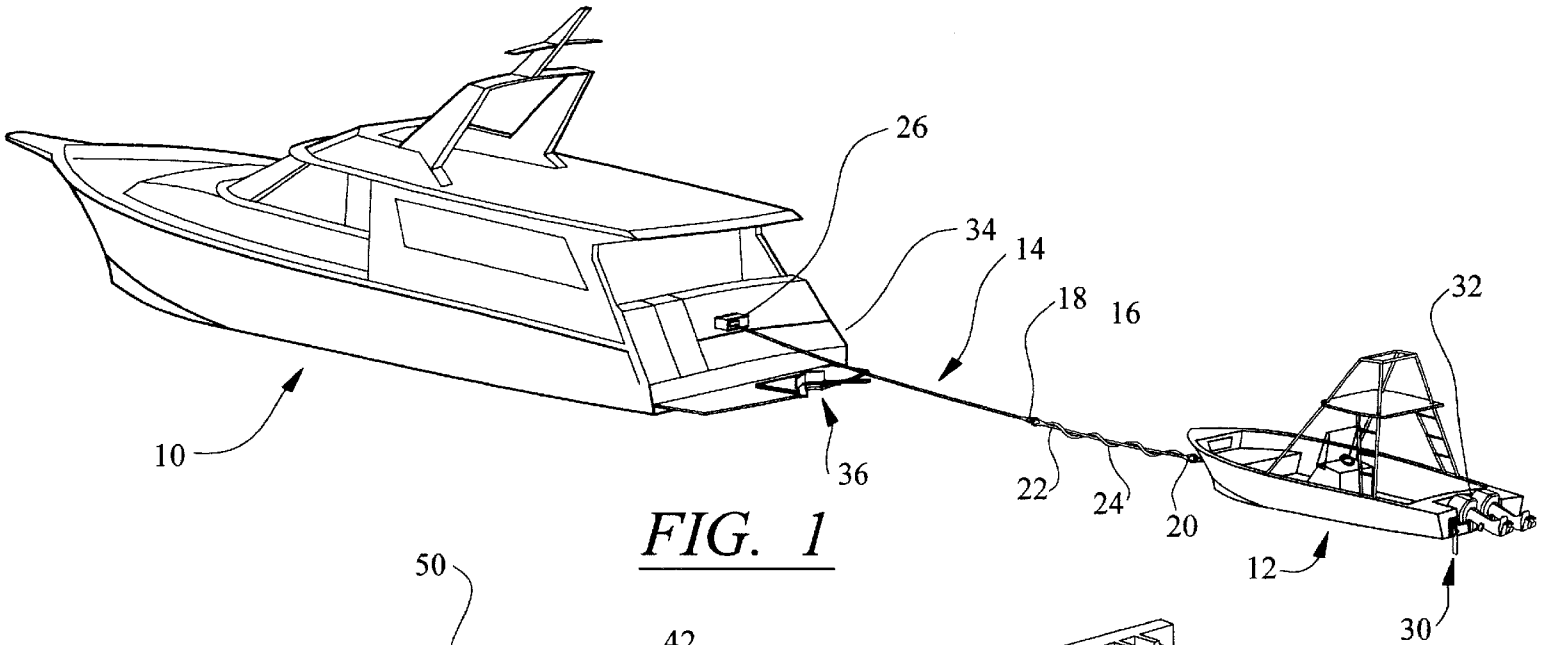
Figure 3:
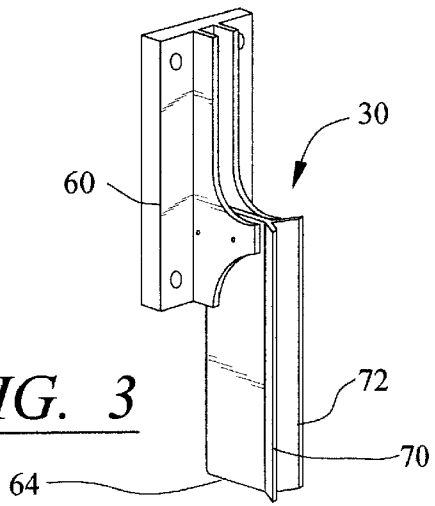
FIG. 3 is a prospective view of a trailing rudder for use on tender.

Now referring to FIG. 1, set forth is a pictorial view depicting a motor yacht 10 which can be of any size but for purposes of an example is depicted as a Hatteras 74 Sport Deck motor yacht which has an overall length of 74' and a beam of 18'. The weight of such a motor yacht extends one hundred thousand pounds and with fuel capacity extending 1,500 gallons the motor yacht is capable of long range cruising to remote islands. For this reason a number of the owners desire to pull a boat capable of fishing and high speed exploring such as the tender 12 depicted in FIG. 1 which is secured to the motor yacht 10 by a tow line. For purposes of this example, the tender depicted is a Regulator 26 having a center consul with a beam of 8'6". Such a boat has a weight of approximately 5,000 lbs., and can handle up to 500 horse power. Thus, the motor yacht for long range cruising at slower speeds is complimented by a tender capable of high speeds but not designed for cruising.

A motor yacht of this length is not capable of accommodating a tender on its deck or superstructure without reinforcement or further jeopardizing the stability of the motor yacht. The tow line 14 includes a towing harness 16 that is coupled to the end 18 of the towing line 14 and to the bow 20 of the tender 12. A harness 16 includes a cord 22 and bridle 24 which will be depicted and explained further in the specification.

The towing line 14 is a deployable tow line that is wound upon a hydraulic winch system, the mechanics of which are set forth in U.S. Pat. Nos. 6,182,592 and 5,746,149, the contents of which are incorporated herein by reference. The preferred embodiment of the line retrieval device is based on hydraulic actuated motors by hydraulic actuator motor which is further actuated by single pressure pump coupled to the line retrieval device by manifold.

Typically this hydraulic system is used in conjunction with the docking apparatus as set forth in the previously mentioned patents. The line retrieval device allows the operator of the vessel to move the tender to a location that is most appropriate for the sea conditions and speed of the motor yacht. For instance, the operator of the boat may the pre-set the tender to track the motor vessel at a position that allows the tender to track the motor yacht without swaying, drifting, or porpoising by placement of a portion of the tenders hull on the back side of the center wake made by the motor yacht. Should sea conditions change the operator may reposition the tender while underway, or on-the-fly, by simply deploying more line or retracting the line to a position that eliminates the after mentioned problems and allows the tender to be trailed under a constant and consistent line stress.

In this manner the line retrieval system can be properly designed for the tender and the life of the line predicted. For instance, the use of a metal cable for pulling of a tender is inappropriate as a metal cable would have no shock absorbing tendencies unless properly snubbed. Similarly the use of a one inch nylon line for a tender of this example fails to provide proper elasticity and can over stress the pulling ring on the tender leading to a catastrophic breakage. Further, a larger line results in the use of a larger spool located on the line retrieval device making it more expensive and requiring more space for positioning. However, the use of a small line for instance a ⅜" nylon line would provide too much elasticity and then high sea conditions or extreme stress would result in breakage of the line. Thus it becomes important for the tender to be placed at a position that allows for proper calculation of the line size and bridle size capable of handling most all situations the motor yacht and tender may encounter.

At the rear of the tender 12 a rudder or skeg 30 is positioned, which allows the tender 12 to properly track the motor yacht 10 in sea condition that otherwise does not allow proper tracking. For instance, the tender 12 is depicted with two outboard motors 32 which when placed in an stowed position allows the tender 12 to draw the draft of less than 2'. However, when the outboard motors are up the hull of the boat provides no directional control as the outboard motors 32 and their rudders operate as the rudder during the powered operation of the tender.

The transom 34 of the motor yacht includes a bow cradle 36 mounted on swim platform 40 which allows the bow 20 of the tender 12 to be pulled into the cradle 36 when the motor yacht 10 is in close quarters such as pulling into a harbor. Unique to this invention is the ability to the line retrieval device 26 to retract the tow line 14 when the bow 20 is securely held against the transom 34 by use of the cradle 36 when the tender in effect operates in a similar direction of fashion as the motor yacht. Thus, the operator of the vessel does not have the typical concern of having a tow line becoming entangled about the propellers or the tender drifting into another vessel during docking maneuvers. The operator of the vessel may rotate the motor yacht while the tender is secured to the motor yacht and simply operates as an extension to the motor yacht with combinations necessary only for length of the overall boat during the docking maneuver.

Figure 6:
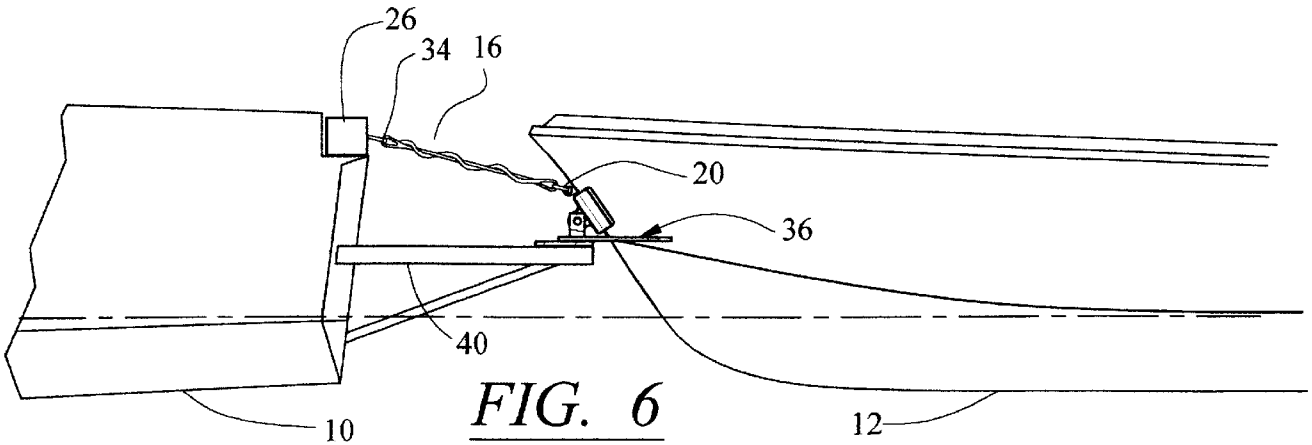
FIG. 6 is a pictorial of a portion of the motor yacht and tender secured to each other by placement of the bow of the tender into the cradle located on the transom of the motor yacht.
Figure 7:
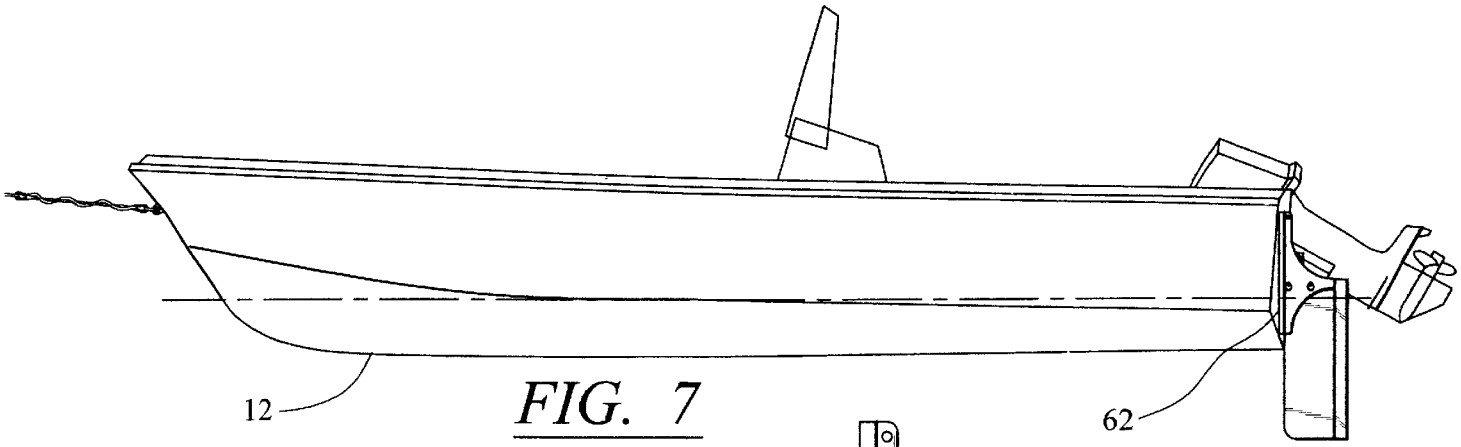
FIG. 7 is a side view of a tender illustrating the removable rudder.
Figure 9:
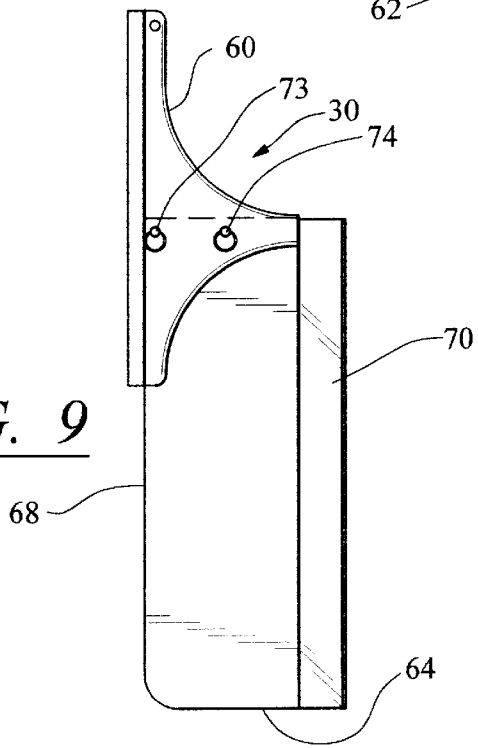
FIG. 9 is a side view of an extended rudder of FIG. 8.
Figure 8:
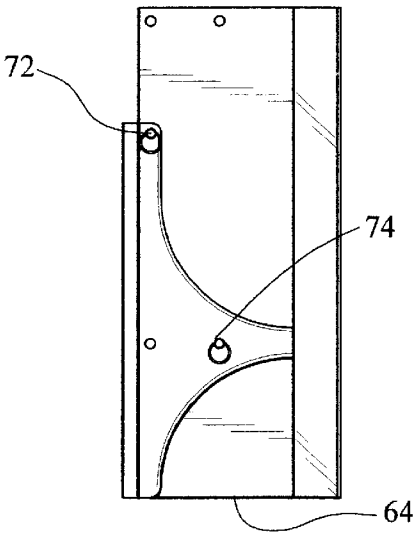
FIG. 8 is the side view of the removable rudder depicted in FIG. 3 shown in the retracted position.

Referring now to FIG. 6 set forth is the tender 12 depicting the bow 20 of the tender placed within the bow cradle 36, the line retrieval device 26 has retracted line 34 wherein only the harness 16 is not retracted into the line retrieval device. Swim platform 40 of the motor yacht 10 can be used as a mounting platform for the bow cradle 36.

Figure 2:
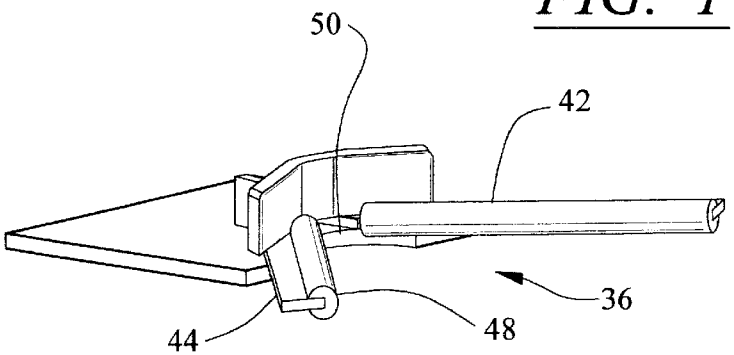
FIG. 2 is a prospective view of a docking port.
Figure 5:
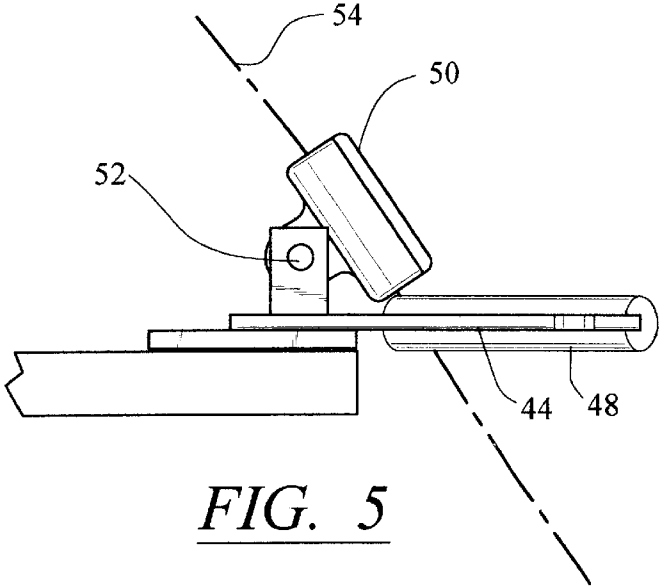
FIG. 5 is a side view of the cradle depicted in FIG. 4.
Figure 4:
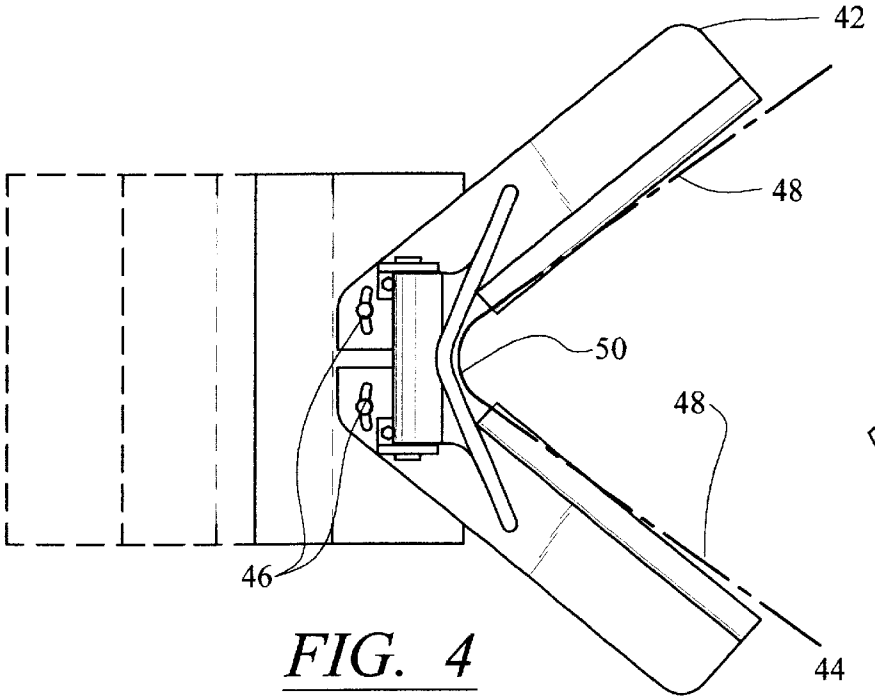
FIG. 4 is a top view of the cradle set forth in FIG. 2.

Referring now to FIG. 2 and FIG. 4 set forth is a perspective view of the bow cradle 36, the bow cradle 36 consists of a first alignment arm 42 and a second alignment arm 44 which are configured to conform along the side walls of the bow of the tender. The alignment arms 42 and 44 are adjustable by use of adjustment bolts 46 but allow for the angular positioning of the alignment arms for purposes of centering the bow of the tender directly between the arms. Each alignment arm includes a cushioning pad such as that depicted by rubber cushions 48. The cushions prevent scratches to the gel coat of the tender hull and further allow for a snug fit to the bow necessary in close quarter maneuvering.

The bow cradle 36 further includes a V-shaped bow stop 50 that is rotatably mounted on pivot point 52 so as to allow the bow stop 50 to rotate thereby accommodating the flat portion 54 of the bow of the boat. For instance, should a passing boat cause a wake while the tender 12 is in close approximation with the motor yacht 10 the transom of the tender may raise wherein the bow stop 50 would rotate along pivot point 52 to accommodate the passing wake. In this manner the bow cradle 36 is universal and adaptable to other types of tenders by simply adjusting the alignment arms 42 and 44 and allowing the bow stop to automatically adjust to the front edge of the tender bow.

Now referring to FIGS. 3, 7, 8 and 9, set forth is the skeg 30 which is a stainless steel structure having a base 60 securable to the transom 62 of the tender 12. The skeg blade 64 has a leading edge 68 and ends in flared trailing edges 70 and 72. In normal tender operation, the blade 64 may, be removed by detachment of latch pins 73, 74 or alternatively as further depicted in FIG. 8, placed in a storage position wherein latch pin 73 is placed along an upper edge on the base 60 and latch pin 74 maintain in its previous position thereby allowing the blade 64 to be stored in a raised position that would not protrude beneath the bottom surface of the hull.

The blade 64 operates as a skeg in the water to maintain the tender in a proper trailing position. If the tender is to drift to the starboard direction, the flare 70 creates a negative pressure so as to draw the tender back to a center position. Similarly should the tender drift to a port direction the flare 70 results in creating the negative pressure causing the tender to drift back to a center location. The flares are placed at approximately 40 degrees and operated as the rudder. While the tender is being pulled properly, the skeg creates drag and as previously mentioned if drifting occurs or skidding the pressure on the flares promotes proper directional tailoring of the tender.

Figure 10:
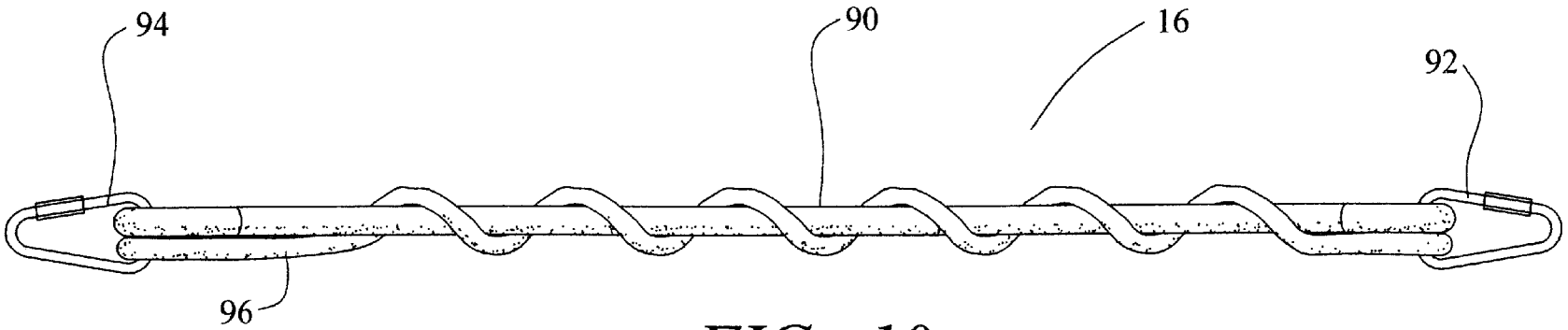
FIG. 10 sets forth a side view of a harness of the instant invention.
Figure 11:
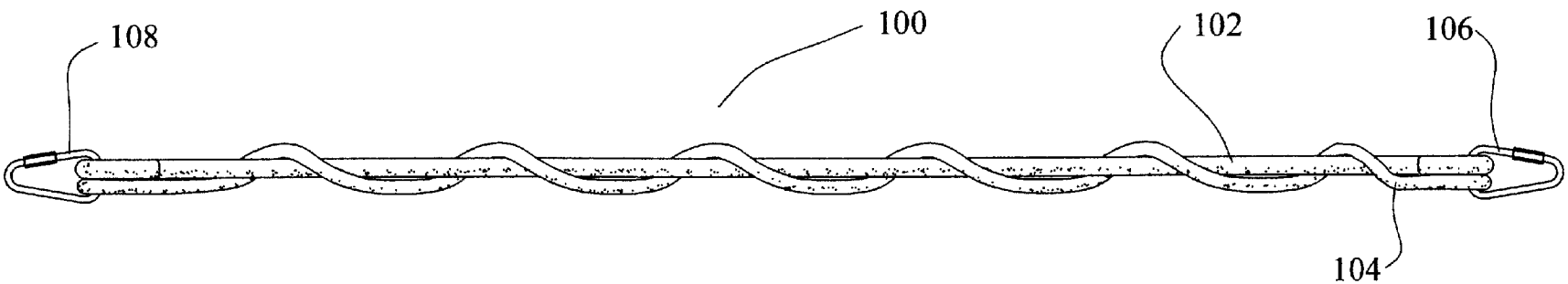
FIG. 11 sets forth a harness of a reduced size similar to FIG. 10.

Referring to FIGS. 10 and 11, set forth is the harness 16 consisting of a cord 90 which is formed from hundreds of individual rubber strands which are bundled together and treated for resistance to UV and saltwater environments. On each end of the cord 90 is located a D shackle 92 and 94. A bridal 96 is secured to each D shackle 92 and 94 and wrapped around the cord 90. The harness 16 is placed at the end of the tow line 14 and the bow of the tender 12. By way of example the disclosed motor yacht and tender would use a harness having a thirty-six (36) inch cord 90 that would consist of hundreds of individual rubber strand which is encompassed by the bridal 96 formed from a three quarter inch nylon line which allows the bridal to be stretched from its rest state of 36 inches to an elongated state of 72 inches wherein the nylon line becomes taunt and prohibits further extension of the cord thereby maintaining the original properties of the cord, and prohibiting longer than 72 inches of stretch sufficient to prevent excess strain to the bow of the tender.

The combination of tow line 14 and harness 16 operates to protect the tender and towing vessel from excess shock in most all sea conditions as the towing line has a predetermined stretch inherent in the nylon cord with the harness operating to prevent excess strain on the line caused by surges from the tender in large seas. FIG. 11 depicts yet another harness 100 formed from a cord 102 and bridal 104. As with the aforementioned harness D shackles 106 and 108 are used on each end of the harness and the size is reduced so as to accommodate a smaller tender however the properties of elasticity remain the same but the use of the bridal preventing excess elongation of the cord thereby preventing damage to the cord and increasing longevity.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. An integrated system for controlling the position of a tender having a powered tow line between a yacht and the tender, said system comprising a tow line having one end wound on a powered winch on the yacht and the other end connected to one end of an elongated harness, the other end of said harness adapted to connected to said tender, a cradle mounted on said yacht having angularly disposed arms adapted to extend along each side of the tender, said cradle having a bow stop pivotally mounted between said arms, said bow stop adapted to contact the tender whereby the position of said tender may be infinitely adjusted from a position in said cradle to a position in the wake of said yacht.

2. The integrated system of claim 1 wherein said tender has a stern and a water line, a skeg attached to the stern, said skeg being movable between a stowed position above said water line and a deployed position below said water line.

3. A method of adjusting the position of a towed tender in relation to a yacht comprising the steps of affixing one end of a tow line about a powered winch on said yacht, affixing the other end of said tow line to a resilient bridle, affixing said bridle to the bow of said tender, making headway with said yacht and tender, adjusting the interval between said tender and said yacht by manipulating said powered winch to place said tender at the desired position in the wake of said yacht, changing said interval between said yacht and said tender in response to changed sea condition while underway.

4. A method of adjusting the position of a towed tender in relation to a yacht as in claim 3 further comprising affixing a cradle to said yacht, and changing said interval between said yacht and said tender until said tender is in said cradle.

* * * * *